United States Patent [19]

Ryntz, Jr. et al.

[11] Patent Number: 4,520,858

[45] Date of Patent: Jun. 4, 1985

[54] CHILL-ENHANCED LOST FOAM CASTING PROCESS

[75] Inventors: Edward F. Ryntz, Jr., Warren; John J. Bommarito, Washington, both of Mich.

[73] Assignee: General Motors Corporation, Detroit, Mich.

[21] Appl. No.: 547,839

[22] Filed: Nov. 2, 1983

[51] Int. Cl.[3] ..... B22C 9/04; B22D 15/00

[52] U.S. Cl. ..... 164/34; 164/127

[58] Field of Search ..... 164/34, 127, 45, 107, 164/236, 352

[56] References Cited

U.S. PATENT DOCUMENTS

| | | | |
|---|---|---|---|
| 3,189,958 | 6/1965 | Newbold | 164/112 |
| 3,204,303 | 9/1965 | Chandley | 164/127 X |
| 3,393,726 | 7/1968 | Schott | 164/34 X |
| 3,598,167 | 8/1971 | Snyderman | 164/236 X |
| 4,010,791 | 3/1977 | Hetke et al. | 164/34 |
| 4,448,235 | 5/1984 | Bishop | 164/34 |
| 4,482,000 | 11/1984 | Reuter | 164/34 |

FOREIGN PATENT DOCUMENTS

| | | | |
|---|---|---|---|
| 527174 | 9/1954 | Belgium | 164/127 |
| 55-97843 | 7/1980 | Japan | 164/34 |
| 56-1260 | 1/1981 | Japan | 164/34 |

OTHER PUBLICATIONS

*Metals Handbook*, 8th Edition, American Society for Metals, vol. 5, 1970, pp. 171–172, 401–402.

*Primary Examiner*—Nicholas P. Godici
*Assistant Examiner*—J. Reed Batten, Jr.
*Attorney, Agent, or Firm*—Douglas D. Fekete

[57] ABSTRACT

A lost foam metal casting process employs a chill member to reduce porosity within a region of a product casting. The chill is adhesively bonded to a fugitive pattern prior to jointly embedding within a particulate sand mold by fluidization, thereby conveniently and reliably arranging the chill and the pattern within the mold for casting.

3 Claims, 1 Drawing Figure

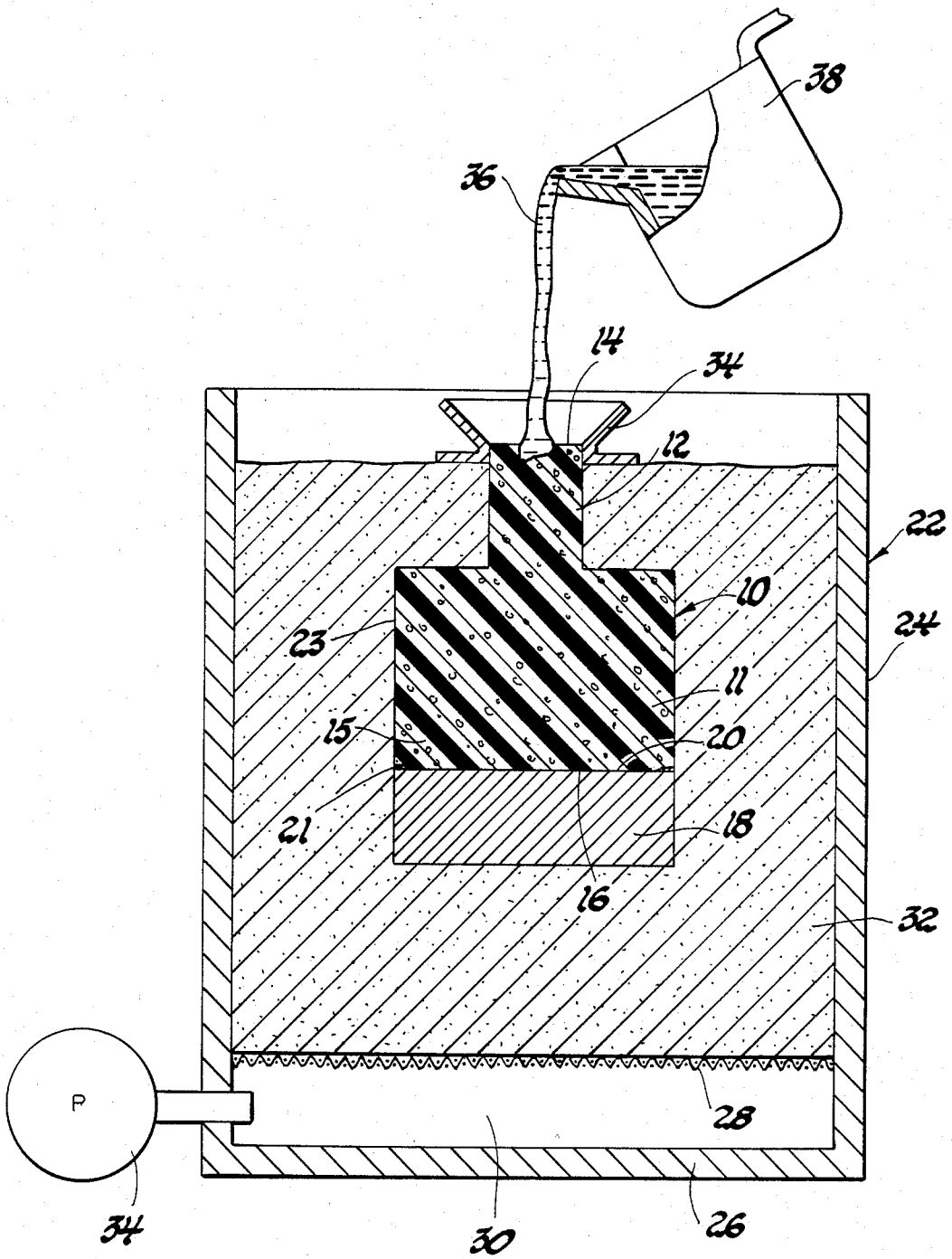
38
36
14
34
12
22
10
24
23
11
15
20
21
18
16
32
P
28
34
30
26

CHILL-ENHANCED LOST FOAM CASTING PROCESS

BACKGROUND OF THE INVENTION

This invention relates to controlling porosity in metal cast within a particulate mold by a lost foam process. More particularly, this invention relates to a lost foam casting process that employs a chill member to reduce or eliminate porosity in a region of a product casting.

In a lost foam metal casting process, a refractory coated vaporizable polymeric pattern is embedded in a mold formed of unbonded refractory particles, i.e., sand, and is decomposed and replaced by molten metal. The pattern is preferably embedded while fluidizing the refractory particles. As the molten metal decomposes the pattern, a substantial volume of vapors vent into the sand mold, thereby allowing the melt to flow in and completely duplicate the pattern. Thereafter, the metal cools and solidifies to form a product casting, whereupon pores tend to form in the metal as a result of precipitation of gases, such as hydrogen, and metal contraction. This porosity undesirably reduces mechanical properties.

Chill members have been employed to locally reduce porosity in metal cast by a process of the type wherein a rigid mold defines a casting cavity, for example, green sand casting. The chill forms a portion of the cavity surface, securely held by the surrounding rigid mold, and accelerates cooling of adjacent metal to quickly solidify a region of the casting before outgassing or shrinkage can form pores. However, chill members have not heretofore been successfully employed for lost foam casting within a nonrigid, cavityless mold. This is attributed in part to the difficulty in effectively arranging a chill and the pattern while forming the mold by fluidization. It has been found that the chill must be positioned in the mold immediately adjacent the pattern. Space between the chill and the pattern fills with melt during casting to prevent pattern surface duplication. Sand or a refractory coating between the members thermally insulates the chill to reduce its cooling effect. It is particularly difficult to exclude fluidized sand from infiltrating between separate members. Furthermore, it has been found that mere separate positioning of a pattern and a chill in the mold, even with great care, does not necessarily achieve the desired local reduction in porosity, perhaps because the position of the chill is not maintained during casting.

Therefore, it is an object of this invention to provide a lost foam metal casting process that employs a chill member to reduce porosity in a region of a product casting, which process comprises assembling a vaporizable pattern and a chill in a fixed arrangement prior to inserting into a fluidized particulate bed to form a mold. This permits the chill and the pattern to be arranged without the inconvenience of the mold forming operations. Thus, the chill may be reliably and effectively positioned adjacent a predetermined pattern surface without sand or space therebetween. Furthermore, the fixed arrangement is maintained not only as the mold is formed, but also during casting until melt has substantially replaced the adjacent pattern, so that thereafter the chill is located effectively to accelerate cooling and solidification and thereby reduce porosity. Premold pattern-chill assembly as provided by this invention is particularly useful for rapidly and conveniently preparing a plurality of molds in a mass production operation.

SUMMARY OF THE INVENTION

In accordance with a preferred embodiment of this invention, a chill member is adhesively bonded to a vaporizable pattern and the bonded assembly is embedded within a particulate mold for lost foam metal casting. More particularly, the chill is affixed to a surface adjacent a region of the pattern wherein it is desired to case pore-free metal. The chill surface is sized and shaped to fit intimately against the pattern surface. The surfaces are bonded by an adhesive agent that is vaporizable at metal casting temperatures. Although the adhesive may be suitably spread over the entire joint, it is generally sufficient to apply a bead about the perimeter.

After the pattern and the chill are bonded together, their arrangement is determined and remains intact during subsequent mold-forming and casting operations. The exposed pattern surface is preferably coated with a vapor-permeable, thermally insulative refractory coating of the type typically employed in lost foam casting to improve metal surface quality and avoid premature solidification. However, the bonded chill covers the adjacent pattern surface to prevent coating from being applied thereto, which coating, if applied, would interfere with heat transfer to the chill. The bonded members are jointly embedded in fluidized sand and the sand packed therearound without admitting sand between the members. Thereafter, molten metal is poured into the mold to decompose and replace the pattern, whereupon the adhesive is also vaporized. However, the bond maintains the position of the chill during casting so that the metal duplicates the pattern surface and thereafter lies in contact with the chill. The chill accelerates heat extraction from the adjacent melt to preferentially solidify the region at a rate sufficient to substantially eliminate porosity. Thus, the process of this invention permits the chill and the pattern to be conveniently assembled in a predetermined arrangement and thereafter to be reliably located within the mold to eliminate porosity in the desired region of a product casting.

DESCRIPTION OF THE DRAWINGS

The only FIGURE is a cross-sectional view of a foundry apparatus for casting metal by a lost foam process and showing a fugitive pattern in combination with a chill member for reducing regional porosity in accordance with this invention.

DETAILED DESCRIPTION OF THE INVENTION

Referring to the FIGURE, a preferred embodiment of this invention is employed to control porosity distribution within aluminum alloy cast by a lost foam process to duplicate a fugitive pattern 10. Pattern 10 comprises a product portion 11 and a downsprue portion 12. Downsprue 12 communicates with product portion 11 for conveying molten metal thereto and includes a melt pour surface 14. For purposes of this description, product portion 11 is adequately depicted by a simple rectangular block, although it may be suitably sized and shaped to cast a desired product of more complex design. Pattern 10 is composed of low density polystyrene foam that vaporizes substantially without residue at aluminum casting temperatures and may be formed in any suitable fashion, for example, by molding preexpanded polystyrene beads or by glueing premolded polystyrene sections together.

In this embodiment, it is desired to cast sound aluminum within a region 15 of pattern product portion 11 adjacent a surface 16. In accordance with this invention, this is accomplished by a chill member 18 affixed to surface 16. Chill 18 is formed of a solid copper block. When molten aluminum is cast against solid copper, heat is rapidly transferred from the melt into the copper, but the two metals do not fuse together. A surface 20 of chill 18 is attached about the perimeter to pattern surface 16 by a hot melt adhesive 21. A suitable adhesive is commercially available from Grow Group, Inc., Troy, Mich., under the trade designation MA 1266, and comprises a blend of hydrocarbon waxes and resins that are vaporizable at aluminum casting temperatures. A bead 21 of the adhesive is applied by brush about the perimeter of chill surface 20. Chill 18 is warmed to a temperature sufficient to melt and activate the adhesive, but not hot enough to decompose polystyrene. Chill surface 20 is pressed against pattern surface 16 and, upon cooling, the adhesive quickly forms a tight bond between the copper and the polystyrene, thereby bonding chill 18 to pattern 10. Chill surface 20 is sized and shaped to fit intimately against pattern surface 16. The thickness of adhesive bond 21 is negligible and is exaggerated in the FIGURE for purposes of illustration, but does not interfere with the desired close fit between surfaces 16 and 20.

After chill 18 is bonded to pattern 10, a thin, porous refractory coating, similar to a core wash, is applied to exposed surfaces 23 of pattern 10, particularly of product portion 11. The coating, which is not shown in the FIGURE because of its relative thinness, improves casting surface quality and provides thermal insulation of the melt during casting to prevent the melt from prematurely solidifying prior to complete pattern replacement. The coating is not applied to pour surface 14 or to surface 16, which is covered by chill 18.

The casting operation is carried out within an open-top rectangular foundry flask 22 formed of gas-impermeable sheet metal sidewalls 24 and floor 26. A porous horizontal partition 28 divides the interior of flask 22 and is spaced apart from floor 26 to define a plenum 30 therebetween. A bed of unbonded sand particles 32, similar to lake sand, rests upon partition 28 within flask 22. Partition 28 is permeable to gas, but supports the sand. Plenum 30 is suitably connected to an exterior air pump 34.

In preparation for casting, the bonded assembly comprising coated pattern 10 and chill 18 is embedded into sand bed 32. Air pump 34 is actuated to blow air under pressure into plenum 30, whereupon the air diffuses through partition 28 and upward through sand bed 32. This forceful air flow imparts an upward motion to individual sand particles, which combines with downward gravitational force to produce in the bed a state approaching fluidity. The pattern-chill assembly is submerged in the fluidized bed and the air flow is discontinued, whereupon the sand packs about the assembly to form a foundry mold. Mechanical vibration of flask 22 aids in compacting the sand firmly about the embedded assembly. As can be seen in the FIGURE, the pattern-chill assembly is positioned in the mold such that product portion 11 is substantially surrounded by compacted sand, pattern surface 16 forms a bottom surface of the pattern in the mold, and chill 18 lies immediately below pattern 10. In addition, downsprue 12 extends slightly above the sand with pour surface 14 uncovered to permit melt access to the pattern. The bonding of chill 18 to pattern 10 as provided by this invention not only permits a single structure to be conveniently embedded in the sand, but also assures that the relative positions of chill 18 and pattern 10 are maintained intact within the mold. In addition, this chill-pattern bonding prevents sand from seeping between pattern surface 16 and chill surface 20 during fluidization and compaction to maintain these surfaces in intimate contact.

After forming mold 32, a pour cup 34 is placed upon the sand about pattern surface 14 and aluminum alloy melt 36 is poured from a ladle 38 into pour cup 34 and thus into contact with pattern surface 14. Heat from melt 36 decomposes the polystyrene, creating substantial vapors that are expelled through the refractory pattern coating into sand mold 32, whereupon melt flows into the space vacated by the vapors. In this manner, the melt progressively destroys the pattern and fills the mold, duplicating the pattern shape. In this example, it is believed that melt replaces surface 16 initially near the center thereof and thereafter progresses outward toward the periphery. Thus, the perimeter bond 21 is not affected by the melt until surface 16 has been substantially replaced. Upon reaching bond 21, the melt vaporizes the adhesive and expels the resulting vapors, in a manner similar to the polystyrene. However, the bond endures for sufficient time to prevent the position of chill 18 from shifting during casting and thus ensure that the melt duplicates pattern surface 16 and is cast against chill surface 20.

After replacing pattern 10, the aluminum cools and solidifies to form a product casting. The casting is readily removed from sand mold 32, for example, by dumping flask 22 or by refluidizing the sand. Because bond 21 is destroyed by the casting operation and the aluminum does not fuse to the copper, the casting is readily separated from chill 18. Inspection of a casting cross section indicates porosity within the metal. However, metal cast adjacent chill 18, i.e., in the casting region corresponding to pattern region 15, is substantially pore-free.

After the pattern is replaced during casting, heat from the metal is extracted by the chill at a substantially greater rate than through the refractory coating into the sand. As a result, metal solidifies quickly adjacent the chill, well before the bulk of the casting, and the solidified metal rapidly grows in a direction away from the chill as the chill continually absorbs heat. This rapid directional solidification is characterized by a solidified front that continually advances into the liquid phase. As the front advances, dissolved hydrogen or other solute is rejected and remains in the liquid. Any hydrogen that might precipitate is quickly engulfed in solid metal and is thus prevented from aggregating to form a bubble of sufficient size to form a microscopic pore. In addition, metal contraction is fed by liquid from more slowly solidifying regions. Thus, these major causes of porosity are substantially eliminated.

Eventually, as the chill temperature rises and the distance to the solidification front increases, the effectiveness of the chill is reduced. Thus, after a pore-free region, porosity gradually increases with distance from the chill and is generally uniform throughout the remainder of the casting. In addition to reducing porosity, directional solidification may also improve grain structure and reduce segregation effects to further enhance mechanical properties in the chill-cooled region.

The effectiveness of the chill, indicated by the size of the pore-free region, depends upon the thermal gradient between the chill and the melt, which, in turn, depends upon several factors including, for example, melt temperature, chill size and material, and casting size and shape. In general, a higher melt temperature or a more massive casting section requires a greater heat transfer to produce solidification and reduces the distance over which the chill is effective. It has been found that a chill is particularly useful for reducing porosity within thinner, more rapidly cooling casting sections.

Suitable chill materials are characterized by high thermal diffusivities. Thermal diffusivity is defined as the thermal conductivity divided by the product of specific heat times density and is related to the ability to rapidly absorb heat. This, in combination with the mass, determines the heat transfer properties of the chill. Preferably, the chill material does not fuse to the metal to be cast. In addition to copper, graphite and cast iron form suitable chills for casting aluminum. This method may also be suitably carried out using a chill cooled by circulating water and provides additional advantages in locating hose connections conveniently within the mold.

In the preferred embodiment, the chill is affixed to a lower surface of the pattern in the mold. It is believed that the process of this invention is not limited to any particular chill orientation and thus permits a chill to be suitably located against a desired region regardless of its relative position on the pattern. However, location near a lower surface is preferred to avoid blocking pattern decomposition vapors that vent upwardly through the mold for release into the atmosphere, which blockage, if allowed to occur, might hinder complete venting of the vapors or undesirably disturb the sand mold or chill position. Also, while in the depicted embodiment the chill surface and adjacent pattern surface are planar, the chill surface may be sized and shaped to intimately fit against a pattern surface of a desired contour.

While in the described embodiment a hot melt adhesive is employed, other adhesives are suitable for binding the metal chill to the polymeric pattern. Preferably, the adhesive vaporizes at metal casting temperatures and does not degrade the pattern material by its application. The adhesive may be applied to the entire joint, particularly for relatively small surfaces. However, it is desired to minimize the adhesive to reduce costs and minimize casting problems that result from the relative difficulty in vaporizing and venting the adhesive, which is typically denser than the pattern material. For this reason, it is desired to apply adhesive only to selected areas of the faying surfaces strategically located to bond the chill and pattern until the pattern surface has been substantially replaced by melt. In general, a perimeter bead is sufficient.

The process of this invention is particularly useful for locating chills and patterns within sand molds in mass production foundry operation. The process permits the chill and the pattern to be readily assembled away from the mold in a relatively convenient glueing operation and ensures that the desired arrangement is maintained within the mold and during casting. Furthermore, it allows the mold to be formed by fluidization, which is particularly conducive to commercial casting operations.

While this invention has been described in terms of certain embodiments thereof, it is not intended that it be limited to the above description but rather only to the extent set forth in the claims that follow.

The embodiments of the invention in which an exclusive property or privilege is claimed are defined as follows:

1. A lost foam casting process for producing a metal casting having a region characterized by substantially reduced porosity and comprising adhesively bonding a vaporizable pattern to a chill member using a vaporizable adhesive agent, said chill member being characterized by a relatively high thermal diffusivity, embedding the bonded assembly of the chill member and the pattern within a mold formed of unbonded refractory particles, pouring molten metal into the mold to vaporize and replace the pattern including a region immediately adjacent the chill member, whereupon the adhesive agent is also vaporized, cooling and solidifying the metal within the mold to form a product casting, said chill member accelerating cooling of metal in the region thereadjacent to preferentially solidify the metal, and removing the product casting from the mold and separating the product casting from the chill member, whereupon the metal within the region cast adjacent the chill member exhibits reduced porosity as a result of said chill-enhanced solidification.

2. A lost foam metal casting process for producing a metal casting having a region characterized by reduced porosity, said process comprising forming a fugitive pattern of a low density polystyrene material vaporizable at metal casting temperatures, said pattern being sized and shaped for duplication by metal to form a product casting and comprising a region wherein reduced porosity metal is desired, bonding a chill member formed of a high thermal diffusivity material to a portion of the pattern surface adjacent said region, said bond being effectuated by an organic adhesive agent vaporizable at metal casting temperatures, applying a suitable, vapor-permeable, thermally insulative coating to remaining portions of the pattern surface not covered by the chill member, submerging the bonded assembly of the pattern and chill member into a fluidized bed of refractory particles, compacting said refractory particles about said submerged assembly to form a foundry mold about the pattern and the chill member, whereupon the relative positions of the pattern and chill member are maintained within the mold by the bond therebetween, pouring molten metal into the mold to decompose and replace the pattern including the region adjacent the chill member and further to decompose said adhesive bond, whereupon the molten metal is cast immediately against the chill member, cooling and solidifying the metal within the mold to form a product casting, said chill member accelerating cooling of metal in the region thereadjacent to rapidly solidify the metal and thereby to minimize porosity therein, removing the product casting from the mold, and separating the product casting from the chill member.

3. A lost foam casting process for producing an aluminum casting having reduced porosity in a surface-adjacent region thereof, said process comprising forming a fugitive pattern of a low density polystyrene material vaporizable at aluminum casting temperatures, said pattern being sized and shaped for duplication by metal to form a product casting and comprising a region corresponding to the desired reduced porosity region of the product casting, bonding a chill member to the pattern using a hot melt adhesive such that a faying surface of the chill member lies immediately adjacent a pattern surface in the vicinity of said region and the adhesive bond extends along the perimeter of the faying surfaces, said chill member being formed of a relatively high thermal diffusivity material nonfusible to cast aluminum, applying a suitable, vapor-permeable, thermally insulative refractory coating to remaining portions of the pattern surface, but not to said surface adjacent the chill member, embedding the bonded assembly of the coated pattern and the chill member within a mold formed of unbonded foundry sand particles by submerging the assembly within a fluidized bed of said sand particles and thereafter compacting the sand particles about the assembly to form the mold, said assembly being oriented within the mold such that said chill member lies immediately below the pattern, pouring aluminum alloy melt into the mold to vaporize and replace the pattern including said region, whereupon said adhesive is also vaporized to dissolve the bond to the chill member, said melt replacing said pattern such that the region surface is substantially replaced prior to dissolving the bond, cooling and solidifying the aluminum alloy within the mold to form an aluminum casting, said chill member accelerating cooling of the aluminum in the region to solidify the aluminum initially adjacent the chill member and progressively away therefrom, thereby minimizing porosity within said region, and removing the aluminum casting from the mold.

* * * * *